US005259278A

United States Patent [19]

Leas

[11] Patent Number: 5,259,278

[45] Date of Patent: Nov. 9, 1993

[54] MAGNETIC SOCKET RETAINER

[76] Inventor: S. Darlene Leas, 5605 Manning, Raytown, Mo. 64133

[21] Appl. No.: 928,740

[22] Filed: Aug. 13, 1992

[51] Int. Cl.[5] ..... B25B 13/58

[52] U.S. Cl. ..... 81/180.1; 81/125

[58] Field of Search ..... 81/60–63.2, 81/125, 180.1, 185.2, 900

[56] References Cited

U.S. PATENT DOCUMENTS

| | | | |
|---|---|---|---|
| 2,551,553 | 5/1951 | Wahl | 81/125 |
| 2,688,991 | 9/1954 | Doyle | 81/180.1 |
| 2,806,396 | 9/1957 | Muller | 81/125 |
| 4,718,316 | 1/1988 | Dedrick | 81/180.1 |
| 4,825,732 | 5/1989 | Arnold | 81/180.1 |

*Primary Examiner*—James G. Smith

*Attorney, Agent, or Firm*—Kokjer, Kircher, Bowman & Johnson

[57] ABSTRACT

A magnetic socket holder for use with socket wrenches in which the ball detent has failed. The socket holder includes a donut-shaped magnet which is received within a stainless steel cup having a central hole through which the drive shaft of the socket wrench may pass. The magnet is adhesively secured to the interior of the stainless steel cup, and at least a portion of the exposed faces of the donut-shaped magnet are covered by a resilient coating. The coating serves to protect the magnet against breakage due to mechanical shock. Additionally, the coating will retain the magnet within its roughly donut-shaped configuration, even if the magnet is broken, due to the adhesion between the coating and the magnet. The exposed faces of the stainless steel cup and the resilient coating may be roughened or knurled such that they may be manually grasped with ease in environments in which grease or oil are prevalent.

9 Claims, 1 Drawing Sheet

MAGNETIC SOCKET RETAINER

BACKGROUND OF THE INVENTION

1. Field of the Invention

The present invention relates in general to tools, both hand and power, for driving sockets. In particular, the present invention relates to an improved device for retaining the socket upon a socket driving device.

2. Description of the Related Art

A standard tool employed to impart rotation to various types of fasteners is the common socket wrench. Sockets generally take the form of a hollow cylinder with the first end having a plurality of flats adapted to engage the head of a nut or a bolt with the other end including a square hole or cavity adapted to receive the drive shaft of the socket wrench.

To retain the socket upon the drive shaft, it is a common practice to provide the drive shaft with a resiliently biased ball detent extending outwardly from one of the sides thereof. The square hole in the second end of the socket will include at least one mating cavity, adapted to receive the ball detent, in at least one of the walls forming the square hole. However, with extended use, in particular attaching and removing the sockets to the socket wrench, the ball detent may fail to act properly. This is typically due to relaxation in the spring which biases the ball detent outwardly. Where the ball detent has failed in such a manner, the socket is not securely retained upon the drive shaft and has a tendency to fall therefrom, severely limiting the use of the socket wrench.

To remedy this situation, it has been known to provide the socket wrench with a magnetic socket holder. Such a socket holder takes the general form of a donut-shaped magnet received within a stainless steel cup. The stainless steel cup surrounds and protects the magnet, and includes a central hole through which the drive shaft may pass. In use, the magnetic socket holder would be placed over the drive shaft on the socket wrench, and the socket thereafter applied to the drive shaft in the normal manner. The magnetic properties of the socket holder would create adhesion between the socket wrench and socket, maintaining the socket in the proper work position on the drive shaft.

SUMMARY OF THE INVENTION

An object of the present invention is to provide a magnetic socket holder having increased life.

Another object of the present invention is to provide such a socket holder which is more easily handled.

These and other objects are achieved by a magnetic socket holder for use with socket wrenches in which the ball detent has failed. The socket holder includes a donut-shaped magnet which is received within a stainless steel cup having a central hole through which the drive shaft of the socket wrench may pass. The magnet is adhesively secured to the interior of the stainless steel cup, and at least a portion of the exposed faces of the donut-shaped magnet are covered by a resilient coating. The coating serves to protect the magnet against breakage due to mechanical shock. Additionally, the coating will retain the magnet within its roughly donut-shaped configuration, even if the magnet is broken, due to the adhesion between the coating and the magnet. The exposed faces of the stainless steel cup and the resilient coating may be roughened or knurled such that they may be manually grasped with ease in environments in which grease or oil are prevalent.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
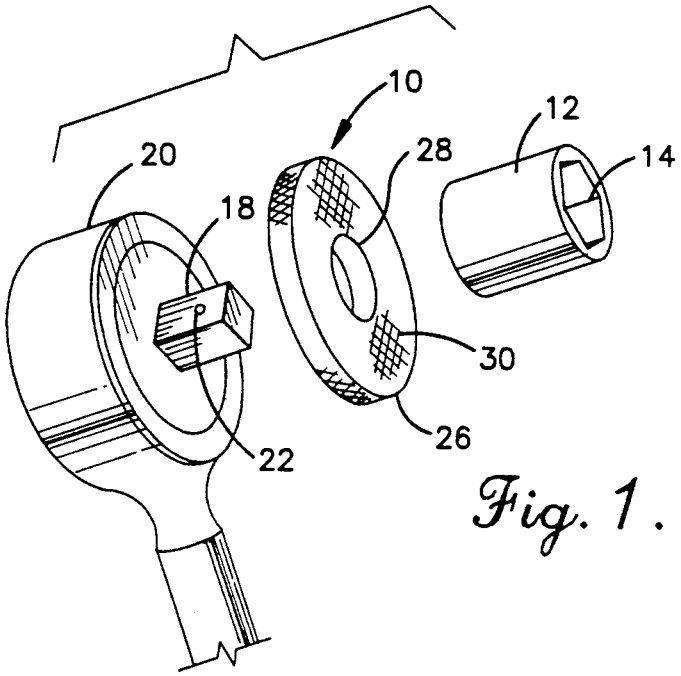
FIG. 1 is an exploded perspective view showing a first embodiment of the device according to the invention in use with a prior art socket wrench and socket.

With reference to FIG. 1, the device according to the present invention is generally designated by reference numeral 10. The device 10 is shown in FIG. 1 as employed with a socket 12 having a generally cylindrical configuration with a first open end including a plurality of flats 14 adapted to engage the hexagonal head of a nut or bolt, and the second end having a square opening 16 (FIG. 2) adapted to receive a drive shaft 18 of a socket driving tool 20. The drive shaft 18 of tool 20 will include an outwardly biased ball detent 22 which is intended to engage with one or more detent cavities 24 within the square opening 16 of socket 12.

The device 10 generally takes the form of a substantially planar annulus having an outer periphery 26 and an inner periphery 28. The planar configuration of device 10 results in a first planar face 30 and a second planar face 32 in spaced, substantially parallel relation.

Figure 2:
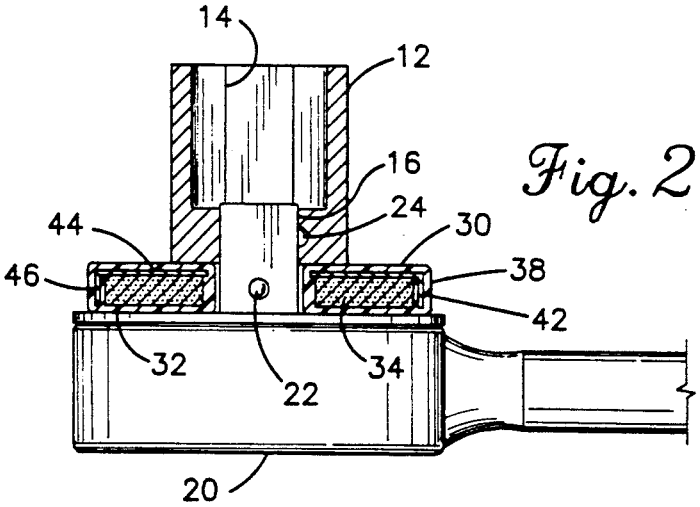
FIG. 2 is a cross-sectional view of the assembled elements of FIG. 1.

As is best shown in FIG. 2, the device 10 is adapted to be placed between the tool 20 and socket 12, with the drive shaft 18 of the tool extending through the inner periphery 28 of device 10 and extending at least partially into the square opening 16 of socket 12. As will become apparent from the discussion below, the device 10 produces a magnetic field which causes the device to be releasably retained to the tool 20, and to the socket 12, such that the socket 12 is retained upon the drive shaft 18 of the tool 20. This will allow the socket 12 to be retained upon the tool 20 even when the ball detent 22 has become inoperative to retain the socket, such as where a spring outwardly biasing the ball detent becomes fatigued.

The structure comprising the device 10 is best shown in FIG. 2.

With reference to FIG. 2, the device 10 includes a magnetic member 34 having the shape of a generally planar annulus. The magnetic member may be ferromagnetic, a ceramic magnet, or other material which produces a sufficient magnetic field to retain the socket 12 to the tool 20 and to the socket 12 with a force sufficient to at least overcome the weight of the largest (and therefore heaviest) socket 12 anticipated to be employed with the tool 20.

Surrounding the magnetic member 34 is a coating of an at least partially resilient material 36. The material 36 may be formed of a variety of substances such as Neoprene, synthetic rubber, or any other material having the desired at least partially resilient property, in addition to the property of not unduly interfering with the magnetic field generated by member 34. As the majority of known materials having this resilient property do interfere to some extent with the magnetic field of member 34, it is preferred that the material 36 be applied as a relatively thin is coating, yet with a sufficient thickness to maintain the magnetic member 34 in its annular configuration should the magnetic member be broken by mechanical shock. The magnetic member will be held in its annular shape due to the resistance of the surrounding coating to the deformations necessary to modify the shape of the magnetic member.

To aid in manipulating the device in a typical repair shop environment, the exterior 38 of the resilient material, or at least a portion or portions of the exterior, may be provided with knurling 40 or other surface treatment to allow the device to be easily grasped and manipulated even when soiled by oil or grease. This knurling or surface treatment may be provided by a heat stamping of material 36 after it has been applied as a coating to magnetic member 34. During this heat stamping process, and the coating process, care should be maintained that the heat imparted to magnetic member 34 is below that which would produce a permanent adverse affect upon its generated magnetic field.

While the resilient material 36 may maintain the magnetic member in its proper annular configuration after it has suffered one or more fractures, it may be advisable to provide the device 10 with a substantially rigid support member 42 to protect the magnetic member 34 against such fracture or breakage. As shown in FIG. 2, the support member 42 may take the general form of an annular cup having a support plate 44 in the general form of a planar annulus, with an inner periphery slightly smaller than or equal to magnetic member 34, and an outer periphery slightly greater than or equal to that of magnetic member 34. The support member 42 also includes a side wall 46 extending substantially perpendicular to plate 44 from the outer periphery of such plate. As may be readily envisioned, the support member 42 will therefore receive the magnetic member 34 within the periphery of side wall 46. Where the side wall 46 extends a distance slightly greater than or equal to the thickness of magnetic member 34, the support member 42 may act as a shield to prevent impact upon a large portion of magnetic member 34.

As with the resilient material 36, the support member 42 should be formed of a material which will not interfere with the magnetic field of member 34. While various materials are suitable, stainless steel has proven to be quite effective for this purpose. As should be apparent, the magnetic member 34 will be attracted to the stainless steel of support member 42 thus maintaining these two elements in the substantially co-axial position shown in FIG. 2. For further support of the magnetic member, it may be desirable to bond the member 34 support member 42 by use of a thin coating of a suitable adhesive. This will provide further support to the magnetic member, reducing the possibility of breakage.

Figure 3:
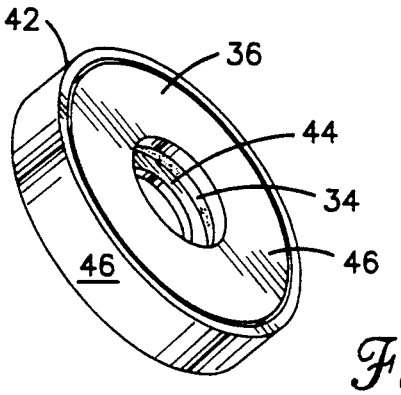
FIG. 3 is a perspective view of a second embodiment according to the present invention.
Figure 4:
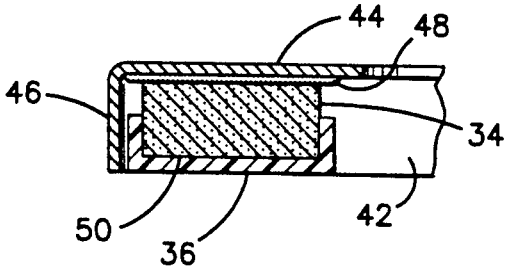
FIG. 4 is a partial cross-sectional view of the embodiment of FIG. 3.

A second embodiment of the present invention is shown in FIGS. 3 and 4. The magnetic member 34 and support member 42 are substantially the same in this embodiment as in first, with the main difference being the required use of an adhesive 48 to bond the magnetic member to the plate 44 of support member 42, and the reduced surface area of the magnetic member 34 which is covered by is the coating of resilient material 36.

In particular, the magnetic member 34 is bonded to the support member 42 at a first planar face 48 thereof, while at least a portion of the second planar face 50 is provided with the coating of material 36.

Such an arrangement will provide sufficient support for the magnetic member 34, due to the adhesive bond between the magnetic member and the support member 42, with this adhesive bond being supplemented by the resilient material 36, such that the magnetic member will retain its annular configuration even upon fracture. The reduced amount of resilient material also reduces interference with the magnetic field of member 34.

While the above embodiment is believed sufficient, it is preferred that the resilient material 36 extend over the entirety of second planar face 50 and over at least a portion of the annular inner and outer peripheral faces of magnetic member 34. As will be apparent, this will provide additional support for the magnetic member upon fracture, but requires that the resilient material bond to the magnetic member to retain its position thereon. Alternatively, a separate adhesive could be employed to bond the resilient material to the magnetic member. It is also possible to completely surround the magnetic member 34 with the coating of material 36, similar to the first embodiment, and then to bond the material 36 to the interior of the support member 42.

As may be seen from FIG. 3, with this second embodiment the resilient material 36 may still be provided with the knurling 40 for improved manual retention. Although not shown, the exterior of the support member 42 may also be provided with knurling or knurled portions to further assist in this.

While the above embodiments have been described with particular regard to a standard socket wrench, it should be apparent to those skilled in the art that the present device is equally useful when used with a power (hydraulic, pneumatic, electric, etc.) socket or impact driver. It should additionally be apparent that various modifications may be made to the device 10 without departing from the spirit of the invention. For example, the peripheral configuration of the magnetic member, and support member 42 need not be similar where the magnetic fields produced by member 34 are not adversely affected. Similarly, the inner and outer peripheries of these members need not be circular, so long as a sufficient magnetic field is generated.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. In combination, a socket driving tool, a socket retention device, and a socket, comprising:

a socket driving tool having a drive shaft adapted to be inserted within a drive opening of a socket;

a magnetic member having first and second substantially planar faces and an outer periphery and an inner periphery defining a through hole, said through hole receiving said drive shaft of said tool therethrough; and a coating of at least substantially resilient material extending over at least a portion of at least one of said planar faces, said coating being secured to said magnetic member such that it will maintain said magnetic member substantially together in the event it is fractured; and said socket being mounted upon said tool with said drive shaft received within said drive opening and an open end adapted to receive an item therein to impart rotation from said tool through said drive shaft, said socket and said open end to the item, said magnetic member being interposed between said tool and said socket and serving to maintain said socket in position upon said drive shaft by magnetic attraction of said magnetic member to said tool and to said socket.

2. A device as in claim 1, wherein said coating completely surrounds said magnetic member.

3. A device as in claim 1, further including a substantially rigid support member secured to said first planar face of said magnetic member, said support member including a through hole substantially corresponding to, and coaxial with, said through hole of said magnetic member.

4. A device as in claim 3, wherein said coating additionally extends over at least a portion of said support member.

5. A device as in claim 3, wherein said support member comprises a substantially planar support plate mounted on said first planar face and including said through hole of said support member, and further comprises a side wall along an outer periphery of said support plate and extending substantially perpendicular to said support plate.

6. A device as in claim 5, wherein said coating extends over at least said second planar face.

7. A device as in claim 6, wherein said coating additionally extends over at least a portion of said outer periphery of said magnetic member, and is located within said side wall of said support member.

8. A device as in claim 7, wherein said magnetic member is adhesively bonded to said support member.

9. A device as in claim 8, wherein said outer and inner peripheries of said magnetic member are substantially circular.

* * * * *